US010409185B2

(12) United States Patent
Pawar et al.

(10) Patent No.: US 10,409,185 B2
(45) Date of Patent: Sep. 10, 2019

(54) TONERS EXHIBITING REDUCED MACHINE ULTRAFINE PARTICLE (UFP) EMISSIONS AND RELATED METHODS

(71) Applicant: Xerox Corporation, Norwalk, CT (US)

(72) Inventors: Siddhesh Nitin Pawar, Norwalk, CT (US); Juan A. Morales-Tirado, Norwalk, CT (US); Grazyna E. Kmiecik-Lawrynowicz, Fairport, NY (US); Daniel W. Asarese, Honeoye Falls, NY (US); Jordan A. Frank, Norwalk, CT (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/891,818

(22) Filed: Feb. 8, 2018

(65) Prior Publication Data

US 2019/0243271 A1 Aug. 8, 2019

(51) Int. Cl.

| | |
|---|---|
| ***G03G 9/08*** | (2006.01) |
| ***G03G 9/093*** | (2006.01) |
| ***G03G 9/087*** | (2006.01) |

(52) U.S. Cl.

CPC ..... *G03G 9/09392* (2013.01); *G03G 9/0802* (2013.01); *G03G 9/0804* (2013.01); *G03G 9/0821* (2013.01); *G03G 9/0825* (2013.01); *G03G 9/08782* (2013.01); *G03G 9/08784* (2013.01)

(58) Field of Classification Search

CPC . G03G 9/08392; G03G 9/0821; G03G 9/0802

USPC ..... 430/137.14

See application file for complete search history.

(56) References Cited

U.S. PATENT DOCUMENTS

| | | | | |
|---|---|---|---|---|
| 6,242,148 | B1 | 6/2001 | Nakajima | |
| 9,639,015 | B2 | 5/2017 | Morales-Tirado et al. | |
| 2007/0134577 | A1 | 6/2007 | Tong et al. | |
| 2014/0294469 | A1* | 10/2014 | Okuma | G03G 15/2064 399/330 |
| 2015/0104742 | A1 | 4/2015 | Morales-Tirado et al. | |

FOREIGN PATENT DOCUMENTS

| | | |
|---|---|---|
| EP | 2833208 | 2/2015 |
| EP | 2902848 | 8/2015 |

(Continued)

OTHER PUBLICATIONS

Particle Emission Characteristic of Office Printers. Environ. Sci. Technol., 2007, 41 (17), pp. 6039-6045. (Year: 2007).*

(Continued)

*Primary Examiner* — Mark A Chapman

(74) *Attorney, Agent, or Firm* — Bell & Manning, LLC

(57) ABSTRACT

Methods of forming a toner are provided. In embodiments, such a method comprises forming a toner from a mixture of at least one resin, at least one wax, and optionally, at least one colorant, wherein the at least one wax is of a type and is present at an amount which are selected to provide a predetermined $PER_{10}$ value for the toner; and measuring a $PER_{10}$ value for the toner, wherein the measured $PER_{10}$ value for the toner is equal to or less than the predetermined $PER_{10}$ value. Toners formed using the methods are also provided.

18 Claims, 1 Drawing Sheet

(56) References Cited

FOREIGN PATENT DOCUMENTS

| | | |
|---|---|---|
| EP | 2977817 | 1/2016 |
| JP | H04 248563 | 9/1992 |

OTHER PUBLICATIONS

Barthel et al., Measurement of Fine and Ultrafine Particles from Office Devices during Printing in order to Develop a Test Method for the Blue Angel Ecolabel for Office-Based Printing Devices, published by Federal Environment Agency, Aug. 2013, pp. 1-186.
Extended Search Report issued on European Application 19155621.6, dated May 28, 2019.

* cited by examiner

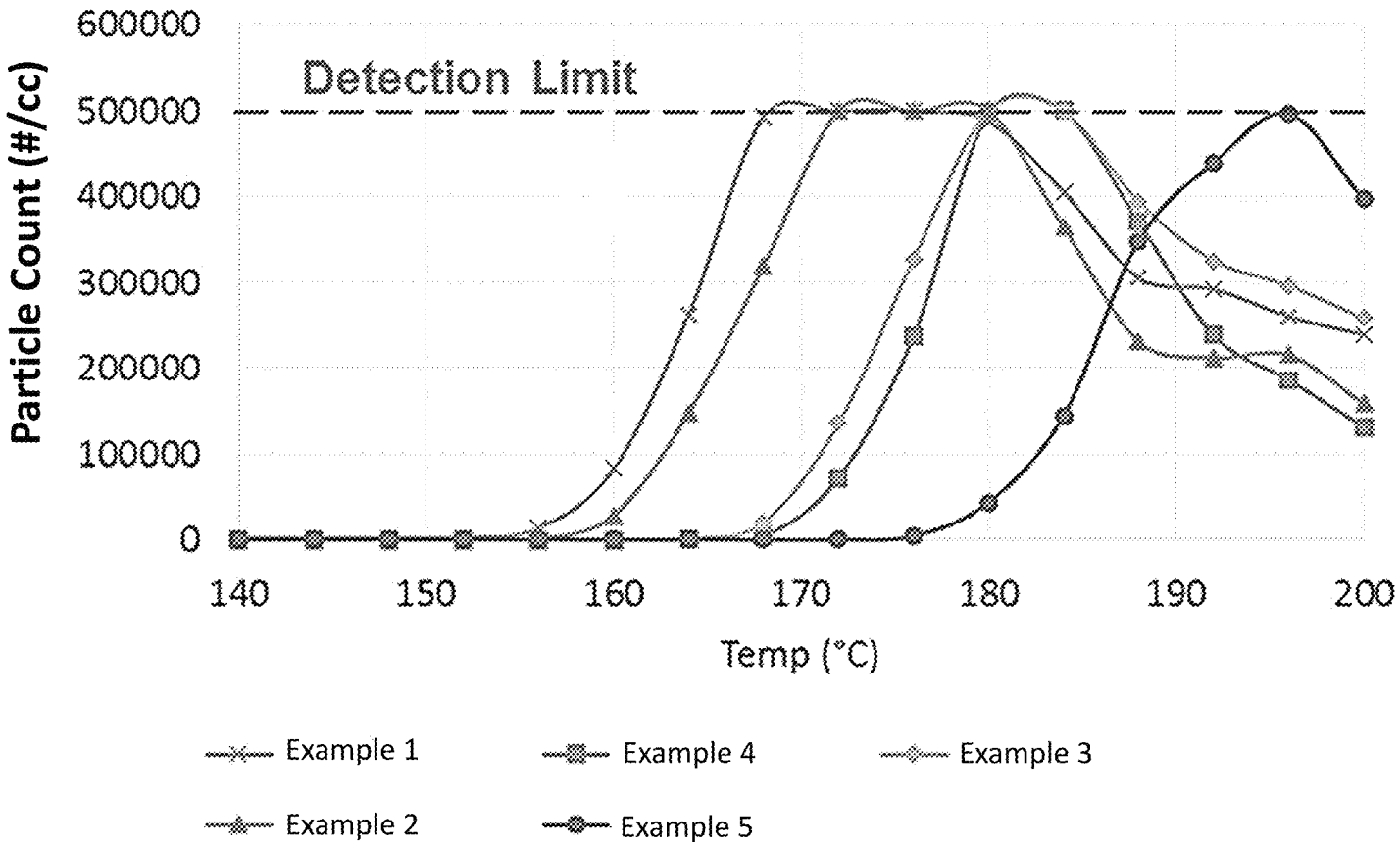
Particle Count (#/cc)
600000
500000
400000
300000
200000
100000
0
Detection Limit
140
150
160
170
180
190
200
Temp (°C)
Example 1
Example 2
Example 3
Example 4
Example 5

TONERS EXHIBITING REDUCED MACHINE ULTRAFINE PARTICLE (UFP) EMISSIONS AND RELATED METHODS

BACKGROUND

Ultrafine particles (UFP) are typically characterized as nanoparticles having sizes of 100 nm or less. Xerographic printing devices can be a source of UFP emissions during normal operation. However, there are numerous possible sources of the UFP emissions, including toner components, fuser roll lubricants or oils, paper, and plasticizers from plastic materials that constitute the main body of the device. Conventional approaches to reducing UFP emission have focused on lowering the fusing temperature of xerographic printing devices.

SUMMARY

The present disclosure provides illustrative examples of toners exhibiting reduced emission of ultrafine particles (UFPs) and related methods.

In one aspect, methods of forming a toner are provided. In embodiments, such a method comprises forming a toner from a mixture of at least one resin, at least one wax, and optionally, at least one colorant, wherein the at least one wax is of a type and is present at an amount which are selected to provide a predetermined $PER_{10}$ value for the toner; and measuring a $PER_{10}$ value for the toner, wherein the measured $PER_{10}$ value for the toner is equal to or less than the predetermined $PER_{10}$ value.

In another aspect, toners are provided. In embodiments, a core-shell toner is provided, the core-shell toner comprising at least one resin, at least one wax, and optionally, at least one colorant, wherein the at least one wax is of a type and is present at an amount which are selected to provide a predetermined $PER_{10}$ value for the toner, further wherein the core-shell toner is characterized by a measured $PER_{10}$ value which is equal to or less than the predetermined PER10 value.

BRIEF DESCRIPTION OF THE DRAWINGS

Illustrative examples of the present disclosure are described with reference to the accompanying drawings.

FIG. 1 shows a plot of particle count versus temperature for a number of toners, each toner having a different type of wax and/or an amount of wax.

DETAILED DESCRIPTION

The present disclosure provides toners exhibiting reduced emission of ultrafine particles (UFPs) and related methods. As further described below, the toners of the present disclosure result in significantly lower UFP emissions when used in xerographic printing devices as compared to their associated comparative toners (e.g., in embodiments, more than 5 times less). At the same time, however, in at least some embodiments the toners of the present disclosure exhibit the same fusing properties as their associated comparative toners.

The toners of the present disclosure comprise at least one resin, at least one wax, and optionally, at least one colorant. The toners may be core-shell toners. Throughout the present disclosure, the toners may be compared to comparative toners. By "comparative toner," it is meant that the composition of the toner and the composition of its comparative toner are the same, except for the waxes of the toner and the comparative toner, which are different. The type of wax, the amount of wax, or both may be different in the toner as compared to its comparative toner. The term "composition," refers to the other toner components as well as the amounts of those components. In addition, by "comparative toner," it is meant that the process of preparing the toner and its comparative toner is the same. In both cases, the term "same" is meant to encompass identical components/amounts/processes as well as components/amounts/processes which may deviate slightly from being identical, but that the deviation is too small to affect the properties of the toner.

By way of illustration, the toners of Examples 1 and 3 are considered to have the same composition (except for the type of wax) and to have been prepared using the same process. Thus, Example 3 may be considered to be a toner of the present disclosure while Example 1 may be considered to be its associated comparative toner. Similarly, Example 4 may be considered to be a toner of the present disclosure while Example 1 may be considered to be its associated comparative toner.

Resins

A variety of resins may be utilized in the toners of the present disclosure. Such resins may be made from any suitable monomers, depending upon the particular polymer to be utilized. Suitable monomers include, but are not limited to styrenes, acrylates, methacrylates, butadienes, isoprenes, acrylic acids, methacrylic acids, acrylonitriles, mixtures thereof, and the like.

Examples of resins include polyolefins, polyethylene, polybutylene, polyisobutyrate, ethylene-propylene copolymers, ethylene-vinyl acetate copolymers, polypropylene, and the like, as well as mixtures thereof. Additional examples of resins which can be used include poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, polyester resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly (styrene-butadiene) resins, and the like, as well as mixtures thereof. However, in some embodiments, a polyester resin is not used.

Examples of other resins include poly(methylstyrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butylacrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene), poly(styrene-propyl acrylate), poly(styrene-butylacrylate), poly(styrene-butadiene-acrylic acid), poly(styrene-butadiene-methacrylic acid), poly(styrene-butadiene-acrylonitrile-acrylic acid), poly(styrene-butylacrylate-acrylic acid), poly(styrene-butylacrylate-methacrylic acid), poly(styrene-butylacrylate-acrylonitrile), poly(styrene-butylacrylate-acrylonitrile-acrylic acid), poly (styrene-butylacrylate-β-carboxy ethyl acrylate), and the like, as well as mixtures thereof.

Examples of other resins include poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly (styrene-butylacrylate-acrylononitrile), poly(styrene-butyl methacrylate), poly(styrene-butyl methacrylate-acrylic acid), poly(butyl methacrylate-butylacrylate), poly(butyl methacrylate-acrylic acid), poly(acrylonitrile-butylacrylate-acrylic acid), and the like, as well as mixtures thereof. The term "alkyl" used in this paragraph may contain from about 1 to about 12 carbon atoms, from about 1 to about 10 carbons, or from about 1 to about 6 carbons.

The polymers of the resin can be block, random, or alternating copolymers, as well as combinations thereof. In embodiments, the resin is a styrene/n-butylacrylate/β-carboxyethylacrylate copolymer wherein the molar ratio of monomers is from about 69 to about 90 parts styrene, from about 9 to about 30 parts n-butylacrylate, and from about 1 to about 10 parts β-carboxyethylacrylate, wherein the weight average molecular weight ($M_w$) value is from about 30,000 to about 40,000, and wherein the number average molecular weight ($M_n$) value is from about 8,000 to about 15,000. Both the $M_w$ and the $M_n$ may be determined using Gel Permeation Chromatography (GPC). In embodiments, the resin has a glass transition temperature ($T_g$) in the range of from about 35° C. to about 75° C., from about 40° C. to about 70° C., or from about 45° C. to about 65° C. The $T_g$ may be determined using Differential Scanning calorimetry (DSC).

In forming the toners, any of the resins described above may be utilized as a latex. Such latexes may be prepared utilizing any of the monomers described above in various amounts, depending upon the resin(s) to be utilized. A variety of emulsion polymerization processes may be used to form such latexes, including semi-continuous emulsion polymerization. A variety of different types of surfactants, initiators, chain transfer agents, crosslinking agents, stabilizers, and combinations thereof, in various amounts, may be used in the processes for forming such latexes.

Toner

The latexes described above may be utilized to form the toners of the present disclosure. As further described below, the toners may include other components, such as a wax and a colorant. Such waxes and colorants may be utilized in dispersions containing a surfactant. A variety of different types of surfactants and combinations of surfactants may be used, including anionic, cationic and nonionic surfactants.

Wax

A wax is included in the toners of the present disclosure. A function of the wax is to provide a release function to minimize the adhesion of the toner layer to the fuser roll during the fusing step. Selection of the wax(es) and the amount of wax(es) in the toner is based, in part, on achieving this release function. However, in the present disclosure, the type of wax(es) and the amount of wax(es) are also selected to suppress the emission of ultrafine particles (UFPs) from the toner, e.g., when being used in a xerographic printing device. As demonstrated in the Examples, below, selection to achieve the release function alone does not necessarily achieve suppression of the emission of UFPs. Regarding suppression of the emission of UFPs, the type of wax(es) and the amount of the wax(es) may be selected to achieve a predetermined $T_{UFP}$ onset value (the temperature at which particle count begins to rise above zero) and/or a predetermined $PER_{10}$ value (the total count of ultrafine particles emitted in a 10 minute print phase of a xerographic printing device). A "predetermined" value refers to the desired value to be obtained as determined prior to formation of the toner. The type and amount of the wax(es) in the toner may also be selected to ensure a particular fusing property (as further described below).

The wax(es) used in the toners of the present disclosure have relatively high melting temperatures ($T_m$), e.g., as compared to the wax(es) of their associated comparative toners. In embodiments, the wax(es) of the toner is characterized by a $T_m$ which is at least 13° C., at least 15° C., or at least 17° C. greater than the $T_m$ of the wax(es) of its associated comparative toner. In embodiments, the wax(es) of the toner is characterized by a $T_m$ of at least 87° C., at least 90° C., or at least 93° C. An illustrative wax which may be used is a polymethylene wax dispersion (e.g., polymethylene wax dispersions available from Cytech Products). Another illustrative wax which may be used is a montanic acid ester wax (e.g., Licowax WE4, WE40, or WM31 available from Clariant). An illustrative wax which may be used is a polyethylene wax dispersion (e.g., D1509 available from Omnova). In embodiments, the toner comprises a single wax (i.e., only one type of wax).

The wax(es) used in the toners of the present disclosure are present in amounts which are relatively small, e.g., as compared to the amount of wax(es) in their associated comparative toners. In embodiments, the toner contains at least 16% less total wax as compared to its associated comparative toner. This includes embodiments in which the toner contains at least 18% less total wax or at least 20% less total wax as compared to its comparative toner. In embodiments, the wax(es) is present in the toner in an amount of no more than 10% by weight of the toner, no more than 9% by weight of the toner, in the range of from 1% to 10% by weight of the toner, from 2% to 10% by weight of the toner, or from 5% to 10% by weight of the toner.

In embodiments, the wax of the comparative toner is a paraffin wax, e.g., a paraffin wax having a $T_m$ of 75° C. In embodiments, the wax of the comparative toner is present in an amount of about 11% by weight of the comparative toner.

Colorants

A colorant may be included in the toners of the present disclosure. Colorants include, for example, pigments, dyes, mixtures thereof, such as mixtures of dyes, mixtures of pigments, mixtures of dyes and pigments, and the like. The colorant may be added in amounts sufficient to impart the desired, color, hue, shade, and the like. The colorant may be present in an amount of, for example, from about 0% to about 20% by weight of the toner, from about 1% to about 15% by weight of the toner, or from about 2% to about 10% by weight of the toner.

Carbon black, which is available in forms, such as furnace black, thermal black, and the like is a suitable colorant. Carbon black may be used with one or more other colorants, such as a cyan colorant, to produce a desired hue.

Examples of cyan pigments include copper tetra(octadecylsulfonamido) phthalocyanine, a copper phthalocyanine colorant listed in the Color Index (CI) as CI 74160, HELIOGEN BLUE L6900™, D6840™, D7080™, D7020™, PYLAM OIL BLUE™, PYLAM OIL YELLOW™ and PIGMENT BLUE I™ available from Paul Uhlich & Co., Inc., CI Pigment Blue (PB), PB 15:3, PB 15:4, an Anthrazine Blue colorant identified as CI 69810, Special Blue X-2137, mixtures thereof, and the like.

Examples of magenta pigments include a diazo dye identified as C.I. 26050, 2,9-dimethyl-substituted quinacridone, an anthraquinone dye identified as C.I. 60710, C.I. Dispersed Red 15, CINQUASIA MAGENTA™ available from E.I. DuPont de Nemours & Co., C.I. Solvent Red 19, Pigment Red (PR) 122, PR 269, PR 185, mixtures thereof, and the like.

Examples of yellow colorants include diarylide yellow 3,3-dichlorobenzidene acetoacetanilide, a monoazo pigment identified in the Color Index as C.I. 12700, C.I. Solvent Yellow 16, a nitrophenyl amine sulfonamide identified in the Color Index as Foron Yellow SE/GLN, LEMON CHROME YELLOW DCC 1026™ CI, NOVAPERM YELLOW FGL from sanofi, Paliogen Yellow 152, 1560 (BASF), Lithol Fast Yellow 0991K (BASF), Paliotol Yellow 1840 (BASF), Neopen Yellow (BASF), Novoperm Yellow FG 1 (sanofi), Permanent Yellow YE 0305 (Paul Uhlich), Pigment Yellow 74, Lumogen Yellow D0790 (BASF), Sunsperse Yellow YHD 6001 (Sun Chemicals), SUCD-Yellow D1355 (BASF), Permanent Yellow FGL, Disperse Yellow, 3,2,5-dimethoxy-4-sulfonanilide phenylazo-4'-chloro-2,5-dimethoxy acetoacetanilide, mixtures thereof, and the like.

Toner Preparation

The toners of the present disclosure may be prepared by any method within the purview of one skilled in the art. Although embodiments relating to toner preparation are described below with respect to emulsion-aggregation (EA) processes, any suitable method of preparing toner may be used, including chemical processes, such as suspension and encapsulation processes. In embodiments, the toners are prepared by EA processes, such as a process that includes aggregating a mixture of a wax, a latex containing a resin, and optionally, a colorant to form aggregated particles, and then coalescing the aggregated particles. The process may involve homogenization, e.g., by mixing at about 600 to about 6,000 revolutions per minute. The wax may be added through a homogenization loop.

An aggregating agent may be added to the mixture of the wax, the latex and optionally, the colorant. Any suitable aggregating agent may be utilized. The aggregating agent may be an inorganic cationic coagulant, such as, for example, a polyaluminum halide, such as polyaluminum chloride (PAC) or the corresponding bromide, fluoride or iodide; a polyaluminum silicate, such as, polyaluminum sulfosilicate (PASS); or a water soluble metal salt, including, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate or mixtures thereof. The aggregating agent may be added to the mixture at a temperature that is below the $T_g$ of the resin.

The aggregating agent may be added to the mixture in various amounts. In embodiments, the amount of aggregating agent is from about 0.1% to about 8% by weight of the mixture, from about 0.2% to about 5% by weight of the mixture, or from about 0.5% to about 2% by weight of the mixture. The aggregating agent may be added in a solution of nitric acid or a similar acid. To control aggregation of the particles, the aggregating agent may be metered into the mixture over time. The addition of the aggregating agent may be accomplished with continued homogenization. The mixture may be further homogenized after addition.

The particles in the mixture may be permitted to aggregate until a predetermined particle size is obtained. A predetermined size refers to the desired particle size to be obtained as determined prior to formation, and the particle size may be monitored during the growth process. Samples may be taken during the growth process and analyzed, for example, with a Coulter Counter. Once the predetermined desired particle size is reached, the growth process is halted. The volume average particle diameter of the aggregated particles may be, for example, from about 3 μm to about 10 μm, in embodiments, from about 5 μm to about 9 μm, or from about 6 μm to about 8 μm.

Shell Resin

After aggregation, but prior to coalescence, a resin coating may be applied to the aggregated particles to form a shell thereover. Any resin described above may be utilized for the shell. In embodiments, the resin utilized for the shell contains a styrene-alkyl acrylate-β-CEA copolymer. In embodiments, the resin is a styrene/n-butylacrylate/β-carboxyethylacrylate copolymer, including a styrene/n-butylacrylate/β-carboxyethylacrylate copolymer having the characteristics described above. However, the resin in the core and the resin in the shell need not be the same. The shell resin may be utilized in the form of a latex as described above.

Once the desired final size of the toner particles is achieved, the pH of the mixture may be adjusted with a pH control agent to a value of, for example, from about 3 to about 10, in embodiments from about 4 to about 9, or from about 4 to about 6. Suitable pH control agents include various bases including alkali metal hydroxides such as, for example, sodium hydroxide, potassium hydroxide, ammonium hydroxide, combinations thereof, and the like. A chelating agent such as ethylenediaminetetraacetic acid (EDTA) or salts of EDTA may be added to help adjust the pH to the desired value. Before coalescence, the temperature of the mixture may be raised, e.g., to a desired coalescence temperature and the pH of the mixture may be adjusted to a desired coalescence pH by adding an aqueous acid solution, e.g., $HNO_3$.

Coalescence

Following aggregation and application of the shell, the particles may then be coalesced to the desired final shape, the coalescence being achieved, by, for example, heating/maintain the temperature of the mixture at a temperature of from about 80° C. to about 110° C., in embodiments from about 85° C. to about 100° C., which may be at or above the $T_g$ of the resin(s) utilized to form the toner particles. The particular selection of temperature is a function of the resins used. Coalescence may be accomplished over a period of time, for example, of from about 1 minute to about 10 hours or from about 5 minutes to about 5 hours. The particles may be coalesced until a desired circularity is achieved. During coalescence, pH control agents may be used to adjust the pH, for example, to a value of from about 3 to about 10, in embodiments from about 5 to about 10, or from about 5 to about 7.

After coalescence, the mixture may be cooled to room temperature. The cooling may be rapid or slow as desired. During cooling, pH control agents may be used to adjust the pH, for example, to a value of from about 3 to about 10, in embodiments, from about 4 to about 9, or from about 6 to about 9. After cooling, the toner particles may be sieved, washed, and then dried.

The toner particles may contain various total amounts of resin, for example, in an amount of from about 60% to about 95% by weight of the toner, from about 65% to about 90% by weight of the toner, or from about 75% to about 85% by weight of the toner.

Additives

The toner of the present disclosure may further contain a variety of additives to enhance the properties of the toner. Charge additives may be present in amounts of, for example, from about 0.1% to about 10% by weight of the toner or from about 0.5% to about 7% by weight of the toner. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, mixtures thereof, and the like.

The toner of the present disclosure may contain surface additives. Surface additives that can be added to the toner particles after washing or drying include, for example, metal salts, metal salts of fatty acids, colloidal silicas, metal oxides, strontium titanates, mixtures thereof, and the like, which each may be present in an amount of from about 0.1% to about 10% by weight of the toner or from about 0.5% to about 7% by weight of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be selected in amounts, for example, of from about 0.05% to about 5% by weight of the toner or from about 0.1% to about 2% by weight of the toner, which additives can be added during the aggregation process or blended into the formed toner particles.

Toner Properties

In embodiments, particles of dry toner, exclusive of external surface additives, have the following characteristics:

(1) Volume average particle diameter of from about 4 μm to about 10 μm, from about 5 μm to about 9 μm, or from about 6 μm to about 8 μm.

(2) Circularity of from about 0.9 to about 1.0, from about 0.92 to about 0.99, or from about 0.95 to about 0.98.

(3) Glass transition temperature ($T_g$) of from about 40° C. to 60° C., from about 42° C. to 58° C., or from about 45° C. to about 55° C.

These properties may be determined as follows. The volume average particle diameter may be measured by a Beckman Coulter Multisizer 3, operated in accordance with the manufacturer's instructions. Representative sampling may occur as follows: a small amount of toner sample, about 1 gram, may be obtained and filtered through a 25 μm screen, then put in isotonic solution to obtain a concentration of about 10%, with the sample then run in the Beckman Coulter Multisizer 3. The circularity may be determined using a FPIA-Sysmex 3000. The $T_g$ may be determined using DSC.

As noted above, the toner of the present disclosure is a toner which exhibits reduced UFP emission, e.g., as compared to an associated comparative toner. UFP emission may be quantified by one or more of a $T_{UFP}$ onset value (the temperature at which particle count begins to rise above zero) and a $PER_{10}$ value (the total count of ultrafine particles emitted in a 10 minute print phase of a xerographic printing device). Measurement of both these values is described in detail in the Examples, below. In addition, reference to a "measured $T_{UFP}$ onset value" and a "measured $PER_{10}$ value," means a measurement as described in the Examples, below.

The toner of the present disclosure may be designed (e.g., by selection of wax type/amount) to achieve a predetermined $T_{UFP}$ onset value and/or a predetermined $PER_{10}$ value. In embodiments, the predetermined $T_{UFP}$ onset value is at least 165° C., at least 170° C., or at least 175° C. The measured $T_{UFP}$ onset value of the toner is generally equal to, but may be greater than the predetermined $T_{UFP}$ onset value. The toners of the present disclosure are characterized by measured $T_{UFP}$ onset values which are greater than those of their associated comparative toners. In embodiments, the toner is characterized by a measured $T_{UFP}$ onset value which is at least 10° C., at least 13° C., or at least 16° C. greater than its associated comparative toner.

In embodiments, the predetermined $PER_{10}$ value is no more than $3\times10^{10}$ particles/cm$^3$, no more than $7\times10^{10}$ particles/cm$^3$, or no more than $1\times10^{11}$ particles/cm$^3$. The measured $PER_{10}$ value of the toner is generally equal to, but may be less than the predetermined $PER_{10}$ value. The toners of the present disclosure are also characterized by measured $PER_{10}$ values which are less than those of their associated comparative toners. In embodiments, the toner is characterized by a measured $PER_{10}$ value which is at least 2 times less, at least 3 times less, or at least 5 times less than its associated comparative toner.

Although the toners of the present disclosure exhibit higher (lower) measured $T_{UFP}$ onset values ($PER_{10}$ values) as compared to their associated comparative toners, at least in embodiments, the toners and their associated comparative toners exhibit the same fusing performance as reflected by one or more of Minimum Fix Temperature (MFT) and Hot Offset Temperature (HOT). These properties may be measured according to the techniques described in the Examples, below. By "the same" it is meant that the measured values for the toners and their associated comparative toners are within at least ±8%, at least ±6%, at least ±4% of each other. In embodiments, the toners, inclusive of external surface additives, exhibit a MFT in the range of from 145° C. to 156° C., from 150° C. to 156° C., or from 152° C. to 155° C. In embodiments, the toners, inclusive of external additives, exhibit a HOT of greater than 195° C.

Developers and Carriers

The toners of the present disclosure may be formulated into developer compositions. Developer compositions can be prepared by mixing the toners of the present disclosure with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2% to about 8% by weight of the toner or from about 4% to about 6% by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Imaging

The toners of the present disclosure may be used in a variety of xerographic printing processes using a variety of xerographic printing devices. By way of illustration, a xerographic printing process may include forming an image with a xerographic printing device including a charging component, an imaging component, a photoconductive component, a developing component, a transfer component, and a fusing component. In embodiments, the development component may include a developer prepared by mixing a carrier with any of the toners described herein. The xerographic printing device may include a high-speed printer, a black and white high-speed printer, a color printer, and the like.

Once the image is formed using a suitable image development method (e.g., magnetic brush development, jumping single component development, hybrid scavengeless development (HSD) and the like), the image may then be transferred to an image receiving medium such as paper and the like. In embodiments, any of the toners may be used in developing an image by utilizing a fuser roll member. Fuser roll members are contact fusing devices that are within the purview of those skilled in the art, in which heat and pressure from the roll may be used to fuse a toner to the image receiving medium. In embodiments, the fuser member may be heated to a temperature above the fusing temperature of the toner, for example to temperatures of from about 70° C. to about 160° C., from about 80° C. to about 150° C., or from about 90° C. to about 140° C., after or during melting onto the image receiving substrate.

EXAMPLES

The following Examples are being submitted to further define various species of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

Five toners were prepared as described in Examples 1-5, below. In each case, particles size was determined using a Beckman Coulter Multisizer III and circularity was determined using a FPIA-Sysmex 3000.

Example 1

A toner was prepared by an emulsion aggregation process. A reactor was initially charged with 29.6 kg of de-ionized water, 13.4 kg of a styrene-butyl acrylate resin in a latex emulsion, 0.71 kg of a Cyan pigment dispersion, and 1.36 kg of a carbon black pigment dispersion. The contents of the reactor were mixed, and then 4.17 kg of a paraffin wax ($T_m$=75° C.) dispersion and 1.39 kg of an acid solution with polyaluminum chloride agglomerating agent were added to the reactor. The wax dispersion was added through a homogenization loop to assure that larger agglomerates were broken down into smaller sized particles. After the wax dispersion and agglomerating agent solution were added to the reactor, all of the components in the reactor were homogenized for 10 min or until the size of the particles in the dispersion was less than 3 μm. The mixture was aggregated for approximately 110 min until the mean aggregate size reached 6.9 μm. After the pre-shell aggregate reached an average particle diameter size of 6.9 μm, the shell resin (an additional 7.69 kg of a styrene-butyl acrylate resin in a latex emulsion) was added to the mixture. Once the final target size was achieved, the growth of the particles was stopped by the addition of sodium hydroxide until the slurry reached a pH of about 5.5. Then, the batch target temperature was raised to 96° C. When the slurry reached a temperature of 80° C., nitric acid was added until a pH of 5.0 was achieved. Once the batch reached 96° C., the temperature of the slurry was maintained, and the circularity of the particles was monitored over time. When the circularity reached the target value of 0.958 the pH of the slurry was adjusted to 6.3 by adding sodium hydroxide. After three hours at 96° C., the temperature of the slurry was lowered to 53° C. at a rate of 0.6° C./min. When the temperature of the slurry reached 53° C. its pH was adjusted by the addition of sodium hydroxide until the pH of the slurry reached a value of 8.8. After the slurry containing the particles having the desired size and circularity was made, the slurry underwent a series of steps referred to as downstream operations. These operations included sieving of the slurry to remove the oversize particles that may have been formed due to the high temperature in the reactor, washing the particles to remove surfactants or other ionic species that may impart undesired charging properties, and removing excess moisture by drying the particles. The dry particles were then blended with various surface additives to impart the desired charging characteristics of the toner.

Example 2

A toner was prepared by an emulsion aggregation process. A reactor was initially charged with 29.6 kg of de-ionized water, 14.0 kg of a styrene-butyl acrylate resin in a latex emulsion, 0.71 kg of a Cyan pigment dispersion, and 1.36 kg of a carbon black pigment dispersion. The contents of the reactor were mixed, and then 3.33 kg of a paraffin wax ($T_m$=75° C.) dispersion and 1.39 kg of an acid solution with polyaluminum chloride agglomerating agent were added to the reactor. The wax dispersion was added through a homogenization loop to assure that larger agglomerates were broken down into smaller sized particles. After the wax dispersion and agglomerating agent solution were added to the reactor, all of the components in the reactor were homogenized for 10 min or until the size of the particles in the dispersion was less than 3 μm. The mixture was aggregated for approximately 110 min until the mean aggregate size reached 6.9 μm. After the pre-shell aggregate reached an average particle diameter size of 6.9 μm, the shell resin (an additional 7.69 kg of a styrene-butyl acrylate resin in a latex emulsion) was added to the mixture. Once the final target size was achieved, the growth of the particles was stopped by the addition of sodium hydroxide until the slurry reached a pH of about 5.5. Then, the batch target temperature was raised to 96° C. When the slurry reached a temperature of 80° C., nitric acid was added until a pH of 5.0 was achieved. Once the batch reached 96° C., the temperature of the slurry was maintained, and the circularity of the particles was monitored over time. When the circularity reached the target value of 0.958 the pH of the slurry was adjusted to 6.3 by adding sodium hydroxide. After three hours at 96° C., the temperature of the slurry was lowered to 53° C. at a rate of 0.6° C./min. When the temperature of the slurry reached 53° C. its pH was adjusted by the addition of sodium hydroxide until the pH of the slurry reached a value of 8.8. After the slurry containing the particles having the desired size and circularity was made, the slurry underwent a series of steps referred to as downstream operations. These operations included sieving of the slurry to remove the oversize particles that may have been formed due to the high temperature in the reactor, washing the particles to remove surfactants or other ionic species that may impart undesired charging properties, and removing excess moisture by drying the particles. The dry particles were then blended with various surface additives to impart the desired charging characteristics of the toner. The surface additives used were the same as those used in Example 1.

Example 3

A toner particle was prepared by an emulsion aggregation process. A reactor was initially charged with 29.3 kg of de-ionized water, 13.4 kg of a styrene-butyl acrylate resin in a latex emulsion, 0.71 kg of a Cyan pigment dispersion, and 1.36 kg of a carbon black pigment dispersion. The contents of the reactor were mixed, and then 4.31 kg of a Polymethylene wax ($T_m$=92° C.) dispersion and 1.39 kg of an acid solution with polyaluminum chloride agglomerating agent were added to the reactor. The wax dispersion was added through a homogenization loop to assure that larger agglomerates were broken down into smaller sized particles. After the wax dispersion and agglomerating agent solution were added to the reactor, all of the components in the reactor were homogenized for 10 min or until the size of the particles in the dispersion was less than 3 μm. The mixture was aggregated for approximately 110 min until the mean aggregate size reached 6.9 μm. After the pre-shell aggregate reached an average particle diameter size of 6.9 μm, the shell resin (an additional 7.69 kg of a styrene-butyl acrylate resin in a latex emulsion) was added to the mixture. Once the final target size was achieved, the growth of the particles was stopped by the addition of sodium hydroxide until the slurry reached a pH of about 5.5. Then, the batch target temperature was raised to 96° C. When the slurry reached a temperature of 80° C., nitric acid was added until a pH of 5.0 was achieved. Once the batch reached 96° C., the temperature of the slurry was maintained, and the circularity of the particles was monitored over time. When the circularity reached the target value of 0.958 the pH of the slurry was adjusted to 6.3 by adding sodium hydroxide. After three hours at 96° C., the temperature of the slurry was lowered to 53° C. at a rate of 0.6° C./min. When the temperature of the slurry reached 53° C. its pH was adjusted by the addition of sodium hydroxide until the pH of the slurry reached a value of 8.8. After the slurry containing the particles having the desired size and circularity was made, the slurry underwent a series of steps referred to as downstream operations. These operations included sieving of the slurry to remove the oversize particles that may have been formed due to the high temperature in the reactor, washing the particles to remove surfactants or other ionic species that may impart undesired charging properties, and removing excess moisture by drying the particles. The dry particles were then blended with various surface additives to impart the desired charging characteristics of the toner. The surface additives used were the same as those used in Example 1.

Example 4

A toner was prepared by an emulsion aggregation process. A reactor was initially charged with 29.5 kg of de-ionized water, 13.4 kg of a styrene-butyl acrylate resin in a latex emulsion, 0.71 kg of a Cyan pigment dispersion, and 1.36 kg of a carbon black pigment dispersion. The contents of the reactor were mixed, and then 3.44 kg of a Polymethylene wax ($T_m$=92° C.) dispersion and 1.39 kg of an acid solution with polyaluminum chloride agglomerating agent were added to the reactor. The wax dispersion was added through a homogenization loop to assure that larger agglomerates were broken down into smaller sized particles. After the wax dispersion and agglomerating agent solution were added to the reactor, all of the components in the reactor were homogenized for 10 min or until the size of the particles in the dispersion was less than 3 μm. The mixture was aggregated for approximately 110 min until the mean aggregate size reached 6.9 μm. After the pre-shell aggregate reached an average particle diameter size of 6.9 μm, the shell resin (an additional 7.69 kg of a styrene-butyl acrylate resin in a latex emulsion) was added to the mixture. Once the final target size was achieved, the growth of the particles was stopped by the addition of sodium hydroxide until the slurry reached a pH of about 5.5. Then, the batch target temperature was raised to 96° C. When the slurry reached a temperature of 80° C., nitric acid was added until a pH of 5.0 was achieved. Once the batch reached 96° C., the temperature of the slurry was maintained, and the circularity of the particles was monitored over time. When the circularity reached the target value of 0.958 the pH of the slurry was adjusted to 6.3 by adding sodium hydroxide. After three hours at 96° C., the temperature of the slurry was lowered to 53° C. at a rate of 0.6° C./min. When the temperature of the slurry reached 53° C. its pH was adjusted by the addition of sodium hydroxide until the pH of the slurry reached a value of 8.8. After the slurry containing the particles having the desired size and circularity was made, the slurry underwent a series of steps referred to as downstream operations. These operations included sieving of the slurry to remove the oversize particles that may have been formed due to the high temperature in the reactor, washing the particles to remove surfactants or other ionic species that may impart undesired charging properties, and removing excess moisture by drying the particles. The dry particles were then blended with various surface additives to impart the desired charging characteristics of the toner. The surface additives used were the same as those used in Example 1.

Example 5

A no-wax toner was prepared by an emulsion aggregation process. A reactor was initially charged with 29.6 kg of de-ionized water, 16.8 kg of a styrene-butyl acrylate resin in a latex emulsion, 0.71 kg of a Cyan pigment dispersion, and 1.36 kg of a carbon black pigment dispersion. The contents of the reactor were mixed, and then 1.39 kg of an acid solution with polyaluminum chloride agglomerating agent was added to the reactor. After the agglomerating agent solution was added to the reactor, all of the components in the reactor were homogenized for 10 min or until the size of the particles in the dispersion was less than 3 μm. The mixture was aggregated for approximately 110 min until the mean aggregate size reached 6.9 μm. After the pre-shell aggregate reached an average particle diameter size of 6.9 μm, the shell resin (an additional 7.69 kg of a styrene-butyl acrylate resin in a latex emulsion) was added to the mixture. Once the final target size was achieved, the growth of the particles was stopped by the addition of sodium hydroxide until the slurry reached a pH of about 5.5. Then, the batch target temperature was raised to 96° C. When the slurry reached a temperature of 80° C., nitric acid was added until a pH of 5.0 was achieved. Once the batch reached 96° C., the temperature of the slurry was maintained, and the circularity of the particles was monitored over time. When the circularity reached the target value of 0.958 the pH of the slurry was adjusted to 6.3 by adding sodium hydroxide. After three hours at 96° C., the temperature of the slurry was lowered to 53° C. at a rate of 0.6° C./min. When the temperature of the slurry reached 53° C. its pH was adjusted by the addition of sodium hydroxide until the pH of the slurry reached a value of 8.8. After the slurry containing the particles having the desired size and circularity was made, the slurry underwent a series of steps referred to as downstream operations. These operations included sieving of the slurry to remove the oversize particles that may have been formed due to the high temperature in the reactor, washing the particles to remove surfactants or other ionic species that may impart undesired charging properties, and removing excess moisture by drying the particles. The dry particles were then blended with various surface additives to impart the desired charging characteristics of the toner. The surface additives used were the same as those used in Example 1.

The toner formulations of Examples 1-5 are summarized in Table 1, below.

TABLE 1

Toner formulations.

| Toner Formulation | Wax Type | Wax Amount (% by weight of toner) |
|---|---|---|
| Example 1 | Paraffin ($T_m$ 75° C.) | 11.28 |
| Example 2 | Paraffin ($T_m$ 75° C.) | 9.00 |
| Example 3 | Polymethylene ($T_m$ 92° C.) | 11.28 |
| Example 4 | Polymethylene ($T_m$ 92° C.) | 9.00 |
| Example 5 | — | — |

Bench Scale Ultra Fine Particle (UFP) Testing

The rate of UFP emissions from toners made according to Examples 1 through 5 was measured using a P-TRak Ultra Fine Particle Analyzer manufactured by TSI operated according to the manufacturer's instructions. The same procedure was used for all toner preparations. 100 grams of toner were placed in a glass vial with a sparge tube attached at the top. A heating block was placed on a hot plate with a thermometer measuring the heating block temperature. The hot plate was turned on and the temperature dial set to a nominal value to control the rate of temperature rise of the heating block. When the temperature of the heating block reached 80° C., the vial was inserted into the block to allow the toner sample to melt. Once the temperature reached 90° C., the particle counter was connected to the outlet of the sparge tube at the top of the glass vial containing the toner sample. When the temperature reached 100° C. the timer was started and the particle count reads from the device were captured at 4° C. intervals until the temperature reached 200° C. The particle counts and temperature data were used to generate the plot of FIG. 1. Toners were tested both blended with surface additives and without. The presence of the surface additives had no significant effect on the results.

As shown in FIG. 1, at lower temperatures, the particle count is low. As temperature rises, the particle count starts increasing and reaches maxima. The temperature at which the particle count begins to rise above zero is termed as the UFP onset temperature ($T_{UFP}$ onset). Depending on the toner, $T_{UFP}$ onset can vary. Consequently, the curves for different toners are shifted relative to each other. Curves that are shifted to higher temperatures (i.e., higher values for $T_{UFP}$ onset) are desirable since this signifies that UFPs are released at relatively higher temperatures under the same set of conditions. In other words, at the same fuser temperature, toner with higher $T_{UFP}$ onset and right shifted curves emit lower UFPs.

As shown in FIG. 1, the no wax toner (Example 5) has the highest $T_{UFP}$ onset. In other words, this toner emits the lowest UFPs at any given temperature. Both Examples 3 and 4 (with polymethylene wax) have $T_{UFP}$ onsets which are higher than those of Examples 1 and 2 (with paraffin wax). Thus, use of a higher $T_m$ polymethylene wax as a replacement for paraffin wax lowers the overall emission of UFPs. For both waxes, using a lower concentration (9.00% vs. 11.28%) slightly improves (i.e., increases) $T_{UFP}$ onset. It is clear from the data that compared to the toner having 11.28% paraffin, the toner having 9.00% polymethylene wax exhibits the greatest improvement in UFP performance.

Machine Ultra Fine Particle (UFP) Testing

The rate of Ultra Fine Particle emissions from Example 1 and Example 4 toners was evaluated after running them in a xerographic printing device that currently uses Example 1 toner. The xerographic printing device was a Monochrome printing device operating at 50 prints per minute. The test procedure and determination of $PER_{10}$ (total UFP particles released in a 10 min print phase) follows that described by The Blue Angel (a German certification for products meeting certain environmental standards). See M. Barthel et al., "Measurement of Fine and Ultrafine Particles from Office Devices during Printing in order to Develop a Test Method for the Blue Angel Ecolabel for Office-Based Printing Devices," Texte 75/2013, Umweltbundesamt, August 2013, which is hereby incorporated by reference in its entirety. However, the test procedure is summarized in Table 2, below, and a summary of the determination of $PER_{10}$ immediately follows.

TABLE 2

Test Procedure for Machine UFP Testing.

| Step Number | Description |
|---|---|
| 1 | Turn on the xerographic printing device. |
| 2 | Flush $N_2$ gas through the chamber at a constant rate for at least 10 min prior to beginning the test. |
| 3 | Connect the P-TRak Ultra Fine Particle Analyzer to the chamber outlet port of the printing device. |
| 4 | Start the pre-print phase (time = 0) and continue for 5 min. Record the particle count at 1 min intervals while the printing device is in standby mode. An average particle count measured over a 10 second period is reported by the instrument. |
| 5 | Begin print phase at the end of the first 5 min by ordering 500 simplex prints. During the print phase, record particle count at 1 min intervals while the machine is running. The print phase for 500 simplex prints lasts for 9 min. During this phase, the particle count increases and reaches a maximum. Note: The format used for printing has 5% area. |
| 6 | Begin post-print phase after the last copy is printed. Continue to record particle count at 1 min intervals for the next 30-40 min after printing. During this time, the particle count decays linearly. |
| 7 | Determine $PER_{10}$ (total UFP particles released in a 10 min print phase). |

A summary of the determination of $PER_{10}$ follows. Modelling of an aerosol (i.e., emitted ultrafine particles) measurement in an emission test chamber can assume simplified conditions with good approximation. The primary measurement is the accumulated particle number concentration $C_p(t)$ in a specified particle size range. Absolute level and dynamics of $C_p(t)$ are essentially determined by the following factors: source strength of the printing device, chamber size, and particle losses in the chamber, primarily through the air exchange rate.

The source strength of the printing device is influenced by its specific product features and the printing activity (length, number of pages and print mode). For different device-specific printing activities, a product comparison requires the standardization of the length of the printing activity, the number of printed pages or other benchmarks. The size of the chamber decides which concentration range should be measured within the detection limits $C_p(t)$.

Particle losses in the chamber can be described by particle loss rate β by adjusting a chamber response function of the type $$R(t) \propto e^{-\beta t} \quad \text{Equation 1}$$

to $C_p(t)$ after the end of the emissions. The source strength can be calculated as rate PER(t), (particles emitted per unit of time). $C_p(t)$ and PER(t) are linked via a convolution integral, which contains the response function R(t):

$$C_p(t) = \int_{t=0}^{t=\tau} PER(t) \cdot R(t-\tau)\, d\tau \quad \text{Equation 2}$$

If the response function has the above-mentioned simple form, rate PER(t) can be determined analytically in [particles/unit time] by deconvoluting the convolution integral. The time derivative can be determined numerically.

$$PER(t) = V_{ch} \cdot \left( \frac{dC_{p(t)}}{dt} - \beta \cdot C_p(t) \right) \quad \text{Equation 3}$$

$$PER(t) = V_{ch} \cdot \left( \frac{C_p(t) - C_p(t-\Delta t) \cdot \exp(-\beta \Delta t)}{\Delta t \cdot \exp(-\beta \Delta t)} \right) \quad \text{Equation 3a}$$

Equations (3) and (3a) are mathematically equivalent and contain only known quantities such as the chamber volume $V_{ch}$ and $C_p(t)$. In Equation 3a, Δt is the time difference between two successive data points. By integration of PER (t) and volume correction, one obtains the total number TP of the particles emitted during a printing activity.

$$TP = \int_{t_{start}}^{t_{stop}} PER(t)\, dt \quad \text{Equation 4}$$

Time $t_{start}$ marks the start of the printing phase and time $t_{stop}$ marks the decline of the emission rate to zero or below a selectable limit. The value of TP can be taken from the integral curve of TP versus time at the point $t_{stop}$ or numerically calculated according to Equation 4.

The end of particle emission, $t_{stop}$ is not always identical to the end of the printing activity but must be determined from the curve of the particle emission rate PER(t) before the calculation of TP. The emission time is determined by the difference $$t_{stop} - t_{start} \quad \text{Equation 5}$$

TP provides a benchmark for quantitative analysis of particulate emissions. TP may be related to the number of printed pages which defines the benchmark TP/pp [−] (pp stands for printed pages). Alternative definitions of benchmarks are possible. For instance, the 10 minutes standard length of printing activity can be used as reference to specify an average emission rate $PER_{10}$ [particle/10 minutes]:

$$PER_{10} = TP \cdot \frac{10}{t_{print}[\text{min}]} \quad \text{Equation 6}$$

In Equation 6, $t_{print}$ [min] stands for the actual duration of the printing activity.

The results of the machine UFP testing for the Example 1 and Example 4 toners are shown in Table 3, below.

TABLE 3

Machine UFP Test Results.

| Toner | $PER_{10}$ Replicate 1 | $PER_{10}$ Replicate 2 | $PER_{10}$ Average |
|---|---|---|---|
| Example 1 | $3.71 \times 10^{11}$ | $1.59 \times 10^{11}$ | $2.65 \times 10^{11}$ |
| Example 4 | $6.25 \times 10^{10}$ | $3.78 \times 10^{10}$ | $5.01 \times 10^{10}$ |

The results of Table 3 show that by using a polymethylene wax ($T_m$=92° C.) at a lower concentration as a replacement for a paraffin wax ($T_m$=75° C.), the emission of UFPs from a xerographic printing device can be suppressed significantly (in this case by an average factor of 5.3).

Fusing performance of the toners was also evaluated, specifically, the Minimum Fixing Temperature (MFT) and the Hot Offset Temperature (HOT) was determined for the toners. The MFT measurement was carried out using a tape peel method. When using this method, an image is fused onto a substrate at different temperatures and the image density is measured. A piece of tape is placed on a specific location of the various images and then peeled off. The image density of the area where the tape was peeled off from is measured. The MFT is determined as the lowest temperature at which the ratio of the image density after peeling off the tape and before peeling it off is 0.90. The MFT of Example 1 was 145° C.; the MFT of Example 2 was 149° C.; the MFT of Example 3 was 154° C.; and the MFT of Example 4 was 155° C. The hot offset temperature (HOT) is that temperature at which toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature. The toner of Examples 1-4 exhibited a HOT of greater than 195° C. and none exhibited hot offset over the temperature range of the fuser of the printing device (140° C. to 195° C.).

It will be appreciated that variants of the above-disclosed and other features and functions or alternatives thereof, may be combined into many other different systems or applications. Various presently unforeseen or unanticipated alternatives, modifications, variations or improvements therein may be subsequently made by those skilled in the art, which are also intended to be encompassed by the following claims.

What is claimed is:

1. A method of forming a toner, the method comprising:

forming a toner from a mixture of at least one resin, at least one wax, and optionally, at least one colorant, wherein the at least one wax is of a type and is present at an amount which are selected to provide a measured $PER_{10}$ value of not more than $1\times10^{11}$ particles/cm$^3$ for the toner; and measuring a $PER_{10}$ value for the toner, wherein the measured $PER_{10}$ value for the toner is not more than $1\times10^{11}$ particles/cm$^3$.

2. The method of claim 1, wherein the forming step is an emulsion-aggregation process.

3. The method of claim 1, wherein the measured $PER_{10}$ value is not more than $7\times10^{10}$ particles/cm$^3$.

4. The method of claim 1, wherein the toner is further characterized by a Minimum Fix Temperature in the range of from 145° C. to 156° C., a Hot Offset Temperature of greater than 195° C., or both.

5. The method of claim 1, wherein the toner is further characterized by a Minimum Fix Temperature, a Hot Offset Temperature, or both, which is the same as that of a comparative toner formed by the same method and having the same composition as the toner except for the at least one wax.

6. The method of claim 5, wherein the comparative toner comprises a single wax and the single wax is paraffin at an amount of about 11% by weight of the comparative toner.

7. The method of claim 1, wherein the measured $PER_{10}$ value of the toner is at least 5 times less than that of a comparative toner formed by the same method and having the has the same composition as the toner except for the at least one wax.

8. The method of claim 7, wherein the toner is further characterized by a Minimum Fix Temperature, a Hot Offset Temperature, or both which is the same as that of the comparative toner.

9. The method of claim 1, wherein the at least one wax is characterized by a $T_m$ which is at least 90° C. and the amount of the at least one wax is no more than 10% by weight of the toner.

10. The method of claim 1, wherein the at least one wax is selected from polymethylene, a montanic acid ester, a polyethylene, and combinations thereof and the amount of the at least one wax is no more than 10% by weight of the toner.

11. The method of claim 1, wherein the toner comprises a single wax.

12. The method of claim 11, wherein the single wax is selected from polymethylene, a montanic acid ester, and a polyethylene and the amount of the single wax is no more than 10% by weight of the toner.

13. The method of claim 1, wherein the at least one resin is a styrene/n-butylacrylate/β-CEA copolymer.

14. The method of claim 1, wherein the toner is a core-shell toner.

15. The method of claim 1, wherein the at least one resin is a styrene/n-butylacrylate/β-CEA copolymer; the at least one wax is selected from polymethylene, a montanic acid ester, a polyethylene, and combinations thereof and the amount of the at least one wax is no more than 10% by weight of the toner; and the toner is a core-shell toner.

16. The method of claim 15, wherein the toner comprises a single wax and the single wax is polymethylene or polyethylene.

17. The method of claim 16, wherein the measured $PER_{10}$ value of the toner is at least 5 times less than that of a comparative toner formed by the same method and having the has the same composition as the toner except that the comparative toner comprises paraffin at an amount of about 11% by weight of the comparative toner.

18. The method of claim 17, wherein the toner is further characterized by a Minimum Fix Temperature, a Hot Offset Temperature, or both which is the same as that of the comparative toner.

* * * * *